US007699560B2

(12) United States Patent
Hoebe

(10) Patent No.: US 7,699,560 B2
(45) Date of Patent: Apr. 20, 2010

(54) DUMP ELEMENT, METHOD FOR FORMING A SPATIAL STRUCTURE FROM DUMP ELEMENTS, AS WELL AS SPATIAL STRUCTURE FORMED FROM DUMP ELEMENTS

(75) Inventor: Joseph Maria Hoebe, Alkmaar (NL)

(73) Assignee: Anome B.V. (NL)

( * ) Notice: Subject to any disclaimer, the term of this patent is extended or adjusted under 35 U.S.C. 154(b) by 236 days.

(21) Appl. No.: 11/719,425

(22) PCT Filed: Nov. 18, 2005

(86) PCT No.: PCT/NL2005/000802

§ 371 (c)(1),
(2), (4) Date: May 16, 2007

(87) PCT Pub. No.: WO2006/054894

PCT Pub. Date: May 26, 2006

(65) Prior Publication Data

US 2009/0123231 A1 May 14, 2009

(30) Foreign Application Priority Data

Nov. 19, 2004 (NL) ..... 1027553

(51) Int. Cl.
*E02B 3/12* (2006.01)

(52) U.S. Cl. ..... 405/35; 405/25; 405/33

(58) Field of Classification Search ..... 405/15, 405/16, 17, 21, 25, 29, 34, 35, 33
See application file for complete search history.

(56) References Cited

U.S. PATENT DOCUMENTS

| | | | | | |
|---|---|---|---|---|---|
| 1,554,605 | A * | 9/1925 | Smith | 405/35 |
| 2,201,279 | A * | 5/1940 | Willing | 405/16 |
| 2,248,721 | A * | 7/1941 | Rehfeld | 405/29 |
| 3,380,253 | A * | 4/1968 | Vita | 405/29 |
| 3,399,535 | A * | 9/1968 | O'Neill | 405/29 |
| 3,614,866 | A * | 10/1971 | Kaneko et al | 405/29 |
| 3,636,713 | A * | 1/1972 | O'Neill | 405/29 |
| 3,851,477 | A * | 12/1974 | Romain | 405/33 |
| 5,190,403 | A * | 3/1993 | Atkinson | 405/29 |
| 5,620,280 | A * | 4/1997 | Melby et al. | 405/29 |
| 6,079,902 | A * | 6/2000 | Pettee, Jr. | 405/35 |
| 6,464,429 | B2 * | 10/2002 | Moore | 405/24 |
| 7,097,385 | B2 * | 8/2006 | Tabler | 405/29 |

* cited by examiner

*Primary Examiner*—Frederick L Lagman
(74) *Attorney, Agent, or Firm*—Jennifer E. Lacroix, Esq.; DLA Piper US LLP

(57) ABSTRACT

Dump element for forming a spatial structure (500, 501) such as a filtering or skeleton construction with such dumped dump elements. The dump element (99) comprises a first elongated, curved hook part (1), a second elongated, curved hook part (2), and a spacer (3) between the first (1) and the second hook part (2), which spacer holds said hook parts (1, 2) spaced apart and interlocks them. With a method for forming a spatial structure, dumped dump elements randomly interlock. In a spatial structure, hook parts of individual dump elements lying near each other interlock while then, the hook parts intersect in their longitudinal directions.

19 Claims, 3 Drawing Sheets

DUMP ELEMENT, METHOD FOR FORMING A SPATIAL STRUCTURE FROM DUMP ELEMENTS, AS WELL AS SPATIAL STRUCTURE FORMED FROM DUMP ELEMENTS

The invention relates to a dump element for forming a spatial structure such as a filter or skeleton construction with such dumped dump elements. The invention also relates to a method for forming a spatial structure from dump elements. The invention further relates to a spatial structure formed from dump elements.

An example of a known dump element is a cube for forming, with such cubes, a filter construction for protecting breakwaters, dikes and the like from soil material washing out. By dumping a large number of these known dump elements in one or more layers, a protection from water movements is obtained. Another known form of such a dump element is manufactured from concrete and has a central portion and a number of legs projecting more or less radially from the central portion.

A drawback of these known dump elements is that the dump elements must be of very heavy design to prevent individual dump elements from becoming detached from the protective structure formed by these dump elements as a result of intensive water movements, for instance during storms.

The object of the invention is to improve the mutual connection between dump elements within a spatial structure.

To that end, according to the invention, a dump element, a method, and a spatial structure are provided.

As the dump element according to the invention comprises a first and a second hook part, and a spacer between the first and the second hook part, which spacer holds the two hook parts spaced apart and interconnects them, two or more of such dump elements easily interlock due to hook parts and/or spacers mutually hooking around one another. It proves surprisingly difficult to detach thus interlocked dump elements from each other. This difficulty also arises when the interlocking has occurred, and increases according as the number of interlocked dump elements increases. As a rule, movements of interlocked dump elements lead to a further interlocking of the dump elements, which leads to a spatial structure forming an almost inextricable knot of dump elements.

Specific embodiments of the invention have been laid down in the subclaims.

In the following, the invention is further elucidated with reference to the Figures in the accompanying drawing.

Figure 1:
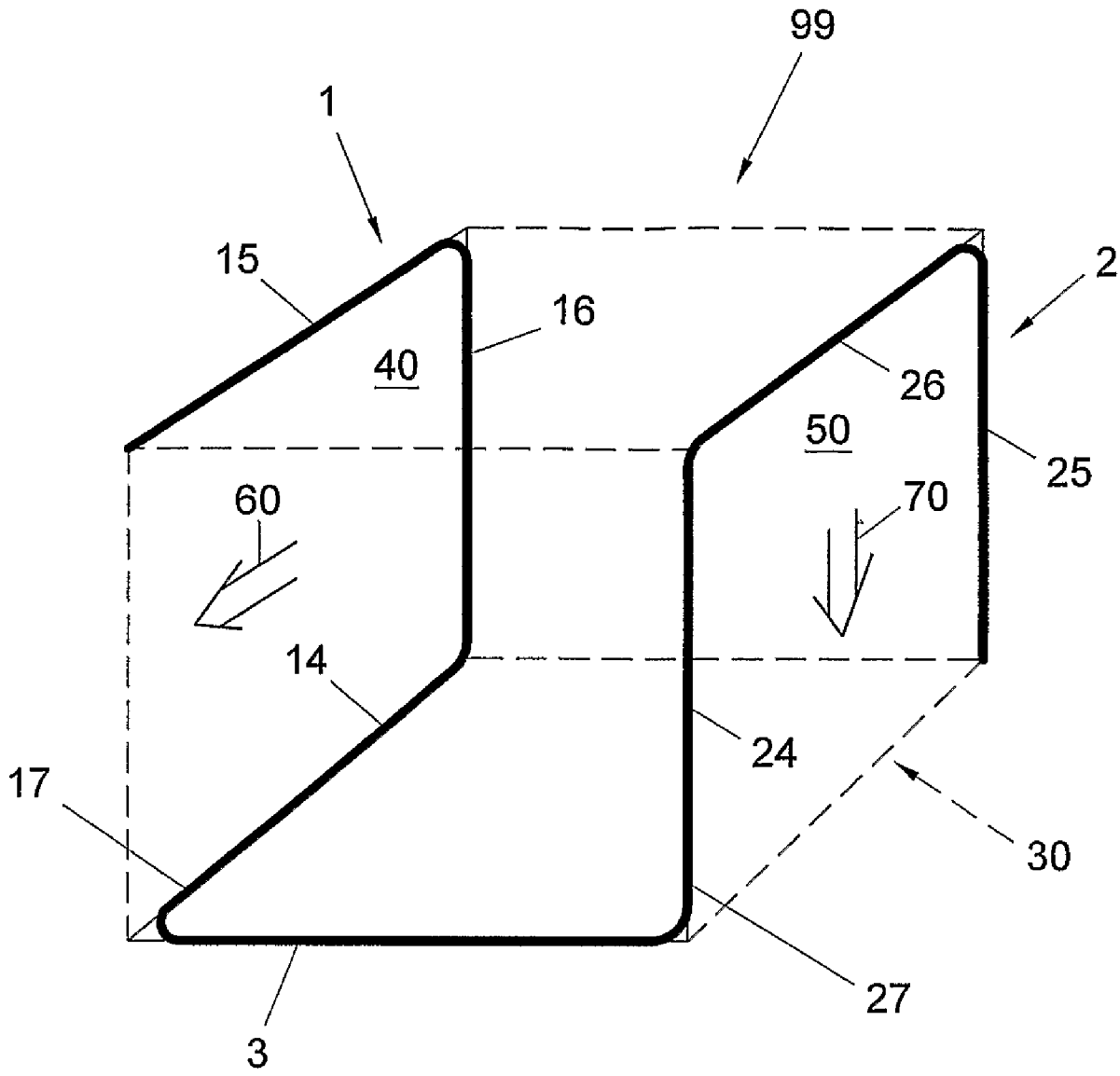

FIG. 1 schematically shows, in perspective view, an example of an embodiment of a dump element according to the invention.

Figure 2C:
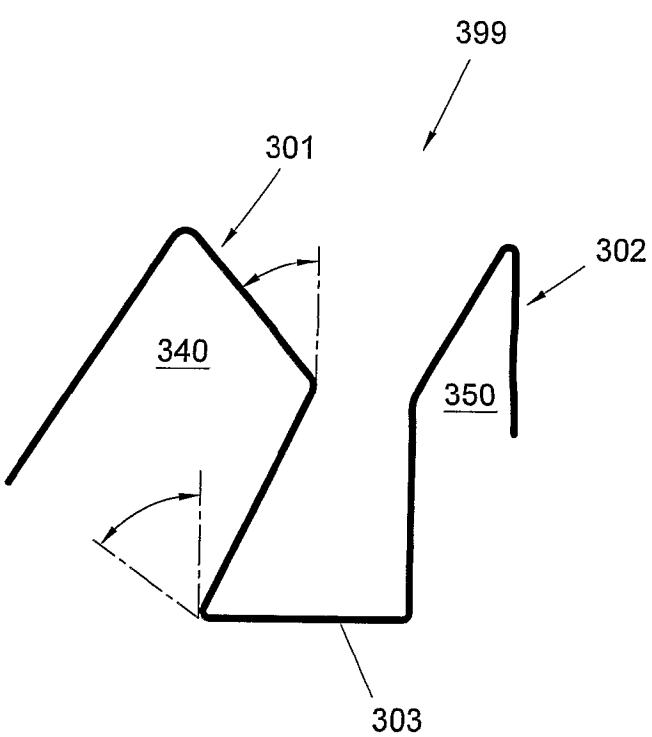
Figure 2B:
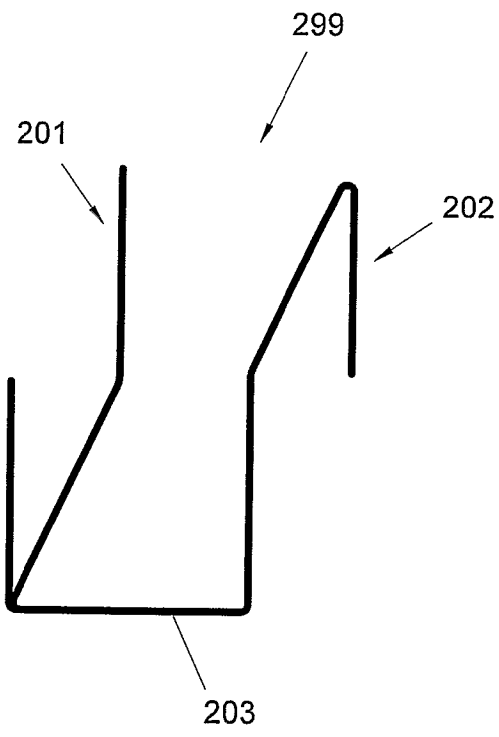
Figure 2A:
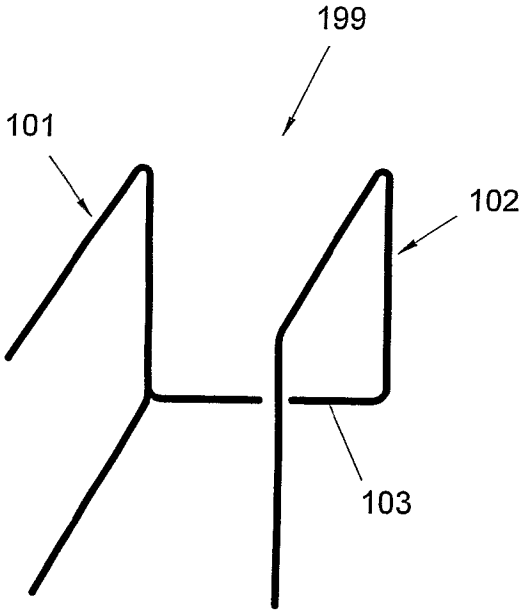

FIGS. 2A, 2B and 2C each schematically show, in perspective view, a different example of an embodiment of a dump element according to the invention.

Figure 3A:
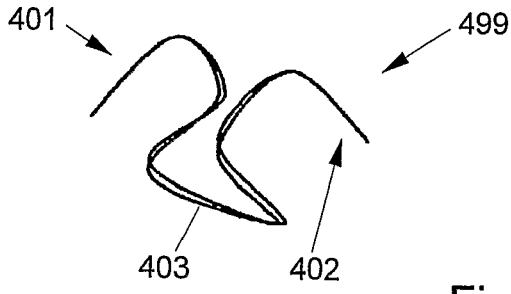

FIG. 3A schematically shows, in perspective view, once more, an example of an embodiment of a dump element according to the invention.

Figure 3B:
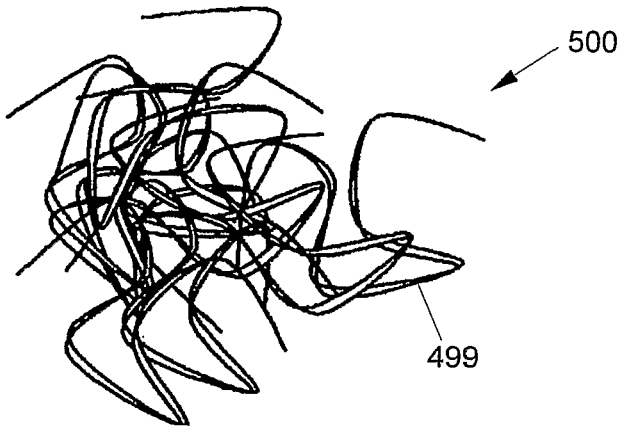
Figure 3C:
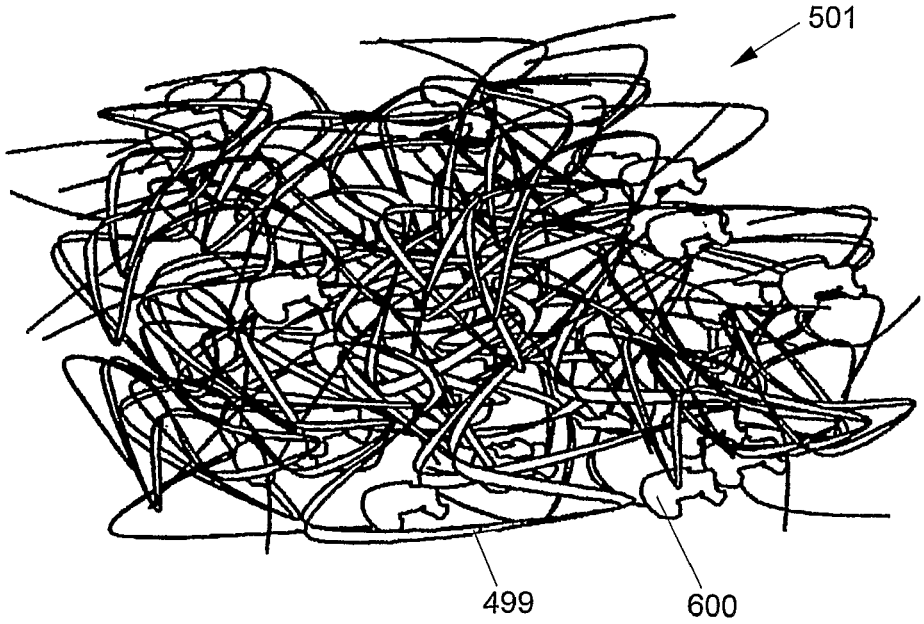

FIGS. 3B and 3C each schematically show, in perspective view, an example of spatial structure formed by several interlocked dump elements according to the invention.

The example shown in FIG. 1 of a dump element 99 according to the invention comprises a first elongated, curved hook part 1, a second elongated, curved hook part 2 and a spacer 3 between the first hook part 1 and the second hook part 2, which spacer 3 holds the hook parts 1 and 2 spaced apart and interconnects them.

The dump element 99 can be manufactured from various materials, for instance (reinforced) concrete, plastic, metal, et cetera. The hook parts 1, 2 and the spacer 3 can be solid or hollow and take various external shapes. They can, for instance, have circular or rectangular cross-sections but various other cross-sectional shapes (varying in longitudinal direction of the hook parts and/or spacers) are possible too. The hook parts 1, 2 and the spacer 3 can also be provided with various sorts of surface structures, projections and the like, and the transitions between the hook parts 1, 2 and spacer 3 can be reinforced in various manners, for instance by designing these transitions with reinforcing elements. Further, parts of the dump element 99 can be detachable from, or hinged relative to each other. The choice of such and other design variations generally depends on the intended use of the dump element 99.

It is noted that "elongated, curved" in the above-mentioned "first elongated, curved hook part" and "second elongated, curved hook part" is understood to mean that the hook part is an elongated body, whose longitudinal direction runs along a particular curvature. The curvature can, for that matter, be a gradual curvature and/or a (very) local curvature.

With the dump element 99 shown in FIG. 1, the first elongated, curved hook part is formed by a first substantially U-shaped part 1 lying substantially in a first plane 40 and which, in the first plane 40, has a free passage to an area between first legs 14 and 15 of the U-shape of the first part 1. The second elongated, curved hook part is formed by a second substantially U-shaped part 2 lying substantially in a second plane 50, different from the first plane 40 and which, in the second plane 50, has a free passage to an area between second legs 24 and 25 of the U-shape of the second part 2. With such U-shaped hook parts a particularly good hooking capacity is obtained.

The transitions between bottom 16 of the first U-shaped part 1 and legs 14 and 15 of the first U-shaped part 1, and the transitions between bottom 26 of the second U-shaped part 2 and legs 24 and 25 of the second U-shaped part 2 can be reinforced in various manners, for instance by designing such transitions with reinforcing elements.

By way of illustration of only a few of the numerous other possible examples of embodiments of dump elements according to the invention, reference is made to the dump elements 199, 299 and 399 which are shown in FIGS. 2A, 2B, 2C, respectively. In these Figures, reference numerals 101, 201 and 301 indicate the first elongated, curved hook parts, the reference numerals 102, 202, 302 the second elongated curved hook parts, and reference numerals 103, 203 and 303 the spacers. By way of example, the hook parts 102, 201, 301, 102, 202 and 302 are U-shaped, nevertheless, different sorts of curvatures are possible. The difference between the dump element 199 of FIG. 2A and the dump element of FIG. 1 is that with the dump element 199, the spacer 103 interconnects other parts of the U-shaped parts 101 and 102. The difference between the dump element 299 of FIG. 2B and the dump element 1 of FIG. 1 is that with the dump element 299, the first U-shaped part 201 is rotated approximately a quarter turn. The difference between the dump element 399 of FIG. 2C and the dump element 1 of FIG. 1 is that with the dump element 399, a first plane 340 of the U-shaped first part 301 makes a different angle with a second plane 350 of the U-shaped second part 302.

Preferably, the spacer links up to a portion of an end of at least one of the hook parts. As the respective end has a portion to which the spacer links up, the respective end is free to a lesser extent. Due to this feature of this exemplary embodiment therefore, the freedom of ends of the dump element is restricted. As interlocked dump elements with less free ends are generally unhooked less easily, the feature mentioned leads to a further strengthened, mutual connection between the dump elements within the spatial structure. With the example shown in FIG. 1, the spacer 3 links up to both the portion 17 of the free end of the leg 14 of the first U-shaped part 1, and the portion 27 of the free end of the leg 24 of the second U-shaped part 2. As, in this manner, two free ends of the U-shaped hook parts of the dump element 99 are no longer completely free, the mutual connection between dump elements 99 within the spatial structure to be formed with these dump elements is particularly strong.

The dump element 99 shown in FIG. 1 further has the property that the assembly of the first hook part 1, the second hook part 2 and the spacer 3 has substantially one single elongated, curved cross-section. This property enhances the hooking capacity of the dump element and, depending on the design of the dump element, simplifies manufacturing the dump element.

It is preferred that the first surface 40 runs substantially parallel to the second surface 50 and the first surface 40 is spaced apart from the second surface 50. Owing to this spaced apart position, parts of a second dump element can gain access to the space between the first and the second plane, which promotes hooking around the first and second U-shaped part, and around the spacer. Owing to the parallel position mentioned, a favorable balance is achieved between, on the one side, parts of the second dump element obtaining easy access from various directions to the space between the first and the second plane and, on the other side, parts of a second dump element leaving said space with difficulty in various directions. Also, due to the parallel position, a compact shape of the dump element 99 can be obtained.

Preferably, the direction 60 (see FIG. 1) in which the free ends of the legs 14 and 15 of the first U-shaped hook part 1 substantially point, differs from the direction 70 (see FIG. 1) in which the free ends of the legs 24 and 25 of the second U-shaped hook part 2 substantially point. As a result, the direction of passage of the free passage to the area between the legs 14 and 15 of the first U-shaped hook part 1 differs from the direction of passage of the free passage to the area between the legs 24 and 25 of the second U-shaped hook part 2. As a result, parts of a second dump element moved towards the dump element in random direction can hook around the dump element more easily. If, then, the bottom 16 of the U-shaped first hook part 1 is substantially parallel to one of the legs 24, 25 or to the bottom 26 of the U-shaped second hook part 2, the dump element 99 has a compact shape.

It is preferred that the spacer 3 is elongated and the spacer 3 and the bottoms 16 and 26 and the legs 14, 15, 24 and 25 of the first and the second U-shaped hook part 1 and 2 have substantially a mutually equal length. As a result, a compact shape of the dump element is obtained whereby, as a rule, several of such dump elements interlock more easily, yet unhook with difficulty. The good hooking capacity of such a dump element with such parts of substantially mutually equal length is further promoted by a suitable choice of thickness/length ratio of those parts. It has appeared that when substantially uniform thickness distributions of these parts are utilized, a particularly good hooking capacity is obtained with thickness/length ratios greater than 1/100, preferably greater than 1/13. A particularly good hooking capacity is further obtained if the referred-to thickness/length ratios are smaller than 1/3, preferably smaller than 1/8.

To obtain a compact and well manipulatable shape of the dump element, it is further advantageous if the spacer 3 and the bottoms 16 and 26 and the legs 14, 15, 24 and 25 of the first and the second U-shaped hook part 1 and 2 each lie substantially along a rib of one and the same imaginary cube 30, see FIGS. 1, 2A and 2B.

Preferably, the first and the second hook part 1 and 2 are substantially identical in shape, and the dump element can be reoriented from a first orientation to a second orientation such that the space taken up by the first hook part 1 in the second orientation substantially corresponds to the space taken up by the second hook part 2 in the first orientation, and that the space taken up by the second hook part 2 in the second orientation substantially corresponds to the space taken up by the first hook part 1 in the first orientation. This is the case with the dump element 99 shown in FIG. 1. With the dump element shown in FIG. 1, this reorientation takes place by first rotating the dump element 99 from the first orientation shown in FIG. 1, in the view of FIG. 1, through 90 degrees to the left about an imaginary perpendicular bisector on the right side of the cube 30, and then rotating the dump element 99 through 180 degrees about an imaginary perpendicular bisector on the, at that moment, upper side of the cube 30. This uniformity in shape and capacity to reorient promote a good manipulatability of the dump elements 99 during, for instance, manufacture of the dump elements or upon storage and transport of ready dump elements. If then, also, the space taken up by the spacer 3 in the first orientation substantially corresponds to the space taken up by the spacer 3 in the second orientation, the good manipulatability of the dump elements 99 is further improved.

The dump elements according to the invention can often be designed such that they are effectively nestable, for the purpose of, for instance, storage and transport. To that end, with the dump element 99 shown in FIG. 1, the completely free ends of the legs 15 and 25, depending on the cross-sections and thicknesses of the dump elements, may be somewhat shortened with respect to the lengths of the ribs of the imaginary cube 30 shown in FIG. 1.

In the following, with reference to FIGS. 3A, 3B and 3C, a method for forming a spatial structure is described. Here, by way of example, a number of dump elements 499 of the type shown in FIG. 3A are used, which dump element is substantially identical in shape to the above described dump element 99 shown in FIG. 1. The dump element 499 has a first elongated, curved hook part 401, a second elongated, curved hook part 402 and a spacer 403 between the first 401 and the second hook part 402. The dump elements 499 are dumped, whereby the dump elements form at least a part of a spatial structure through random interlocking of at least a part of the dump elements.

FIG. 3*b* shows an example of a spatial structure 500 formed by a number of interlocked, dumped dump elements 499. FIG. 3*c* shows an example of a spatial structure 501 formed by a larger number of dumped dump elements 499 compared to the spatial structure 500 of FIG. 3B. It is not necessary that the dump elements for forming a spatial structure are all of the same type. Nevertheless, a mixture of dump elements of various types and/or various dimensions is possible, for instance a mixture of dump elements of the various types shown in FIGS. 1, 2A, 2B and 2C.

As a rule, upon dumping, random dump elements 499 interlock randomly. An advantage of the dumping elements interlocking more or less randomly through dumping is that the spatial structure 500 or 501 is obtained rapidly and effectively.

Further, a filler material can be brought into contact with at least a part of the dump elements. If the spatial structure is intended for, for instance, building up or reinforcing a core of a dike or dune, for instance earth and/or sand and/or gravel and/or the like can be included in the spatial structure. The interlocked dump elements 499 then ensure a strongly linking, mutual connection of the core of the dike or dune. Depending on the filler material used, such a core of a dike or dune can be well transmissive to water and readily admit vegetation on the body. Plants can be rooted solidly in the spatial structure. FIG. 3C shows an example wherein the spatial structure 501 comprises a filler material 600, for instance gravel, which has been brought into contact with a part of the dump elements 499. It is noted that in FIG. 3C, only a few bodies of the filler material have been highly schematically represented, but that in general, it is preferred that the filler material completely fills up the spaces between the dump elements, apart from the normal rest spaces between parts of the filler material. The filler material of the spatial structure can be highly diverse, depending on the use. It can comprise natural (soil) material and/or plastic and/or gel and/or other materials.

With a spatial structure according to the invention, comprising a number of dump elements which each comprise a first elongated, curved hook part and a second elongated, curved hook part, hook parts of individual dump elements lying near each other interlock, with the hook parts intersecting in their longitudinal directions. The curved hook parts thus interlocking while intersecting provides the dump elements within the spatial structure with a strong mutual connection.

The spatial structures to be formed with the dump elements can be employed in many uses, such as (artificial) reef, supports for roads or buildings, preventing soil erosion, soil or mixture reinforcement, dam or flood barrier, guy rope, tarpaulin, floating island, pile head, pad foundation, (steep) slope, temporary road, concrete reinforcement, et cetera. In uses such as floating covering for liquid surfaces, the dump elements can for instance be designed to be hollow and/or in materials with a suitable specific weight. When used on, for instance, sea-floors, as sea-floor reinforcement or building of reefs, the dump elements may be lowered overboard while upon arrival at the bottom, they can interlock, assisted therein by the water currents and/or, for instance, divers.

It is noted that after the aforementioned, various modifications are possible. The dump element can, for instance, comprise one or more additional hook parts and one or more additional spacers between various hook parts. These and similar modifications are understood to fall within the framework of the invention as defined in the accompanying claims.

What is claimed is:

1. A dump element for forming a spatial structure with such dumped dump elements, comprising:

a first hook part;

a second hook part; and a spacer between the first hook part and the second hook part which holds the first and second hook parts spaced apart and interconnects the first and second hook parts;

wherein:

the first hook part has a curved configuration substantially in a first plane, and the second hook part has a curved configuration substantially in a second plane, different from the first plane;

the first hook part is substantially U-shaped having legs and a bottom, and, in the first plane, has a free passage to an area between the legs of the first hook part;

the second hook part is substantially U-shaped having legs and a bottom, and, in the second plane, has a free passage to an area between the legs of the second hook part;

the spacer is elongated; and the spacer, the bottom and the legs of the first hook part, and the bottom and legs of the second hook part have substantially mutually equal lengths.

2. A dump element according to claim 1, wherein the spacer links up to a portion of an end of a leg of at least one of the hook parts.

3. A dump element according to claim 1, wherein the first plane runs substantially parallel to and is spaced apart from the second plane.

4. A dump element according to claim 1, wherein the first and second hook parts each have a direction and the direction in which the first hook part is open, differs from the direction in which the second hook part is open.

5. A dump element according to claim 1, wherein the bottom of the first hook part is substantially parallel to one of the legs or to the bottom of the second hook part.

6. A dump element according to claim 1, wherein the spacer, the bottom and the legs of the first hook part, and the bottom and legs of the second hook part each lie substantially along a rib of an imaginary cube.

7. A dump element according to claim 1, wherein the first and the second hook part are substantially identical in shape and the dump element can be reoriented from a first orientation to a second orientation such that the space taken up by the first hook part in the second orientation substantially corresponds to the space taken up by the second hook part the first orientation, and that the space ace taken up by the second hook part in the second orientation substantially corresponds to the space taken up by the first hook part in the first orientation.

8. A dump element according to claim 7, wherein the space taken up by the spacer in the first orientation substantially corresponds to the space taken up by the spacer in the second orientation.

9. A spatial structure comprising a number of dump elements according to claim 1, wherein hook parts of individual dump elements lying near to each other interlock while intersecting.

10. A spatial structure according to claim 9, further comprising a filler material in contact with at least a part of the dump elements.

11. A spatial structure according to claim 10, wherein the dump elements form a reinforcement of the filler material.

12. A spatial structure according to claim 11, wherein the filler material comprises soil material.

13. A spatial structure according to claim 9, wherein the spatial structure is a covering or reinforcement of a part of the earth's surface.

14. A spatial structure according to claim 13, wherein the part of the earth's surface has a sloping surface.

15. A spatial structure according to claim 14, wherein the part of the earth's surface is a dam.

16. A spatial structure according to claim 13, wherein the part of the earth's surface is situated under water.

17. A spatial structure according to claim 13, wherein the part of the earth's surface has parts above and below a water surface.

18. A method for forming a spatial structure comprising:

providing a plurality of dump elements according to claim 1; and dumping the dump elements whereby the dump elements form at least a part of a spatial structure and at least a part of the dump elements randomly interlock.

19. A method according to claim 18, further comprising the step of bringing into contact a filler material with at least a part of the dump elements.

* * * * *